United States Patent [19]

Allan

[11] Patent Number: 4,997,050

[45] Date of Patent: Mar. 5, 1991

[54] SCABBLER BITS

[75] Inventor: David T. Allan, Glasgow, Scotland

[73] Assignee: John Macdonald and Company (Pneumatic Tools) Limited, Glasgow, Scotland

[21] Appl. No.: 454,077

[22] Filed: Dec. 21, 1989

[30] Foreign Application Priority Data

Dec. 21, 1988 [GB] United Kingdom ..... 8829747

[51] Int. Cl.[5] ..... E21B 10/36

[52] U.S. Cl. ..... 175/414; 175/413; 299/37; 299/88

[58] Field of Search ..... 299/37, 38, 88, 79; 175/414–416, 420, 412, 389, 410, 413, 327, 320; 173/51, 52, 132; 407/48, 54, 102, 103; 404/90

[56] References Cited

U.S. PATENT DOCUMENTS

| | | | |
|---|---|---|---|
| 2,085,941 | 7/1937 | Arnold | 175/412 X |
| 2,145,466 | 1/1939 | Urschel | 175/415 |
| 2,553,435 | 5/1951 | Briese | 299/37 X |
| 2,750,156 | 6/1956 | Coates | 175/419 X |
| 3,100,545 | 8/1963 | Zimmerman | 175/410 X |
| 3,366,420 | 1/1968 | Young | 299/37 |
| 3,603,414 | 9/1971 | Stebley | 175/410 X |
| 3,841,709 | 10/1974 | Kniff | 175/413 X |
| 4,181,187 | 1/1980 | Lumen | 175/413 X |
| 4,502,734 | 3/1985 | Allan | 175/413 X |

FOREIGN PATENT DOCUMENTS

| | | | |
|---|---|---|---|
| 68829 | 5/1983 | European Pat. Off. | |
| 2010163 | 6/1979 | United Kingdom | 173/52 |

*Primary Examiner*—Hoang C. Dang

*Attorney, Agent, or Firm*—Ratner & Prestia

[57] ABSTRACT

A scabbler bit comprises a carrier having a body 30 with a lower face 31 formed to provide bores 32 for receipt of scabbler tips 44. The body 30 has a central bore 33 for passage of a fixing shank 34. The bore 33 is enlarged at the lower face 31 to form a recess 35 to receive the head 36 of the shank 34. The opposite face of the body 30 is formed with a counterbore 37 to receive the piston 38, the shank 34 being retained in the piston by a pin 39. Thus, axial loads on the scabbler bit are transmitted to the piston 38 via shoulder 40 of the carrier bearing on end face 41 of the piston 38, while any sideways of twisting load is resisted by the wall of the counterbore 37 bearing on the side face 42 of the piston 38.

7 Claims, 2 Drawing Sheets

SCABBLER BITS

This invention relates to scabbler bits.

BACKGROUND OF THE INVENTION

Scabbler bits comprise a plurality of cutting tips, usually of tungsten carbide, fitted in the base of a carrier which in turn is fixed to a reciprocating piston of a scabbling machine. In the conventional form of scabbler bit, the carrier is a female member of closed cylindrical form which fits over a male piston and is secured thereon by a through pin. Our European Pat. No. 0,068,829 illustrates such prior art in greater detail and discusses its disadvantages and the disclosure of said European Patent is incorporated herein by reference.

EP-0,068,829 relates to an improved scabbling bit in which the carrier is a male member retained within a cylindrical recess in the piston. This provides a significant improvement upon earlier scabbling bits, but it has been found that in some circumstances problems can occur. FIG. 1 shows one embodiment of scabbling bit in accordance with EP-0,068,829, in which the carrier 10 has a separate fixing shank 12 which passes through a central aperture 14 of the carrier 10 to be seated in a central bore 16 of the piston 18, in which it is retained by a pin 20. It will be seen that the scabbler tips 22 are substantially aligned with the external diameter of the piston 18. This arrangement is satisfactory when the load on the scabbler bit is substantially axial. However, uneven loading on the scabbler tips, or sideways load, can result in distortion or fracture.

It is accordingly an object of the present invention to provide a scabbler bit of male formation in which the foregoing problems are overcome or mitigated.

SUMMARY OF THE INVENTION

The invention provides a scabbler bit comprising a carrier, a plurality of scabbler tips fitted to a lower surface of the carrier, and a shank portion to be received in a bore formed in a piston of a scabbling machine, the carrier having a counterbore formed in an upper surface thereof and providing a side wall dimensioned to abut an external circumferential surface of said piston.

In a preferred embodiment, the shank portion comprises a removable shank passing through a central bore of the carrier. The shank may suitably have a flanged head seating in a recess in said lower surface. The recess has a chamfered transition with the throughbore and terminates in the carrier in a radius.

Preferably, said counterbore terminates in a undercut groove.

The scabbler tips are preferably arranged on two pitch circles of differing radii.

BRIEF DESCRIPTION OF THE DRAWINGS

An embodiment of the present invention will now be described, by way of example only, with reference to the drawings, in which:

FIG. 6 shows a scabbler bit incorporating the carrier of FIGS. 2–4.

DESCRIPTION OF THE PREFERRED EMBODIMENTS

Figure 1:
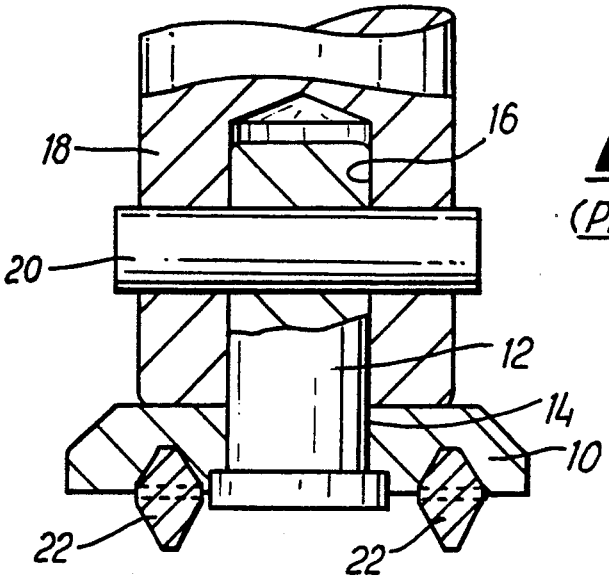
FIG. 1 (Prior Art)
FIG. 1 relates to the prior art described above.
Figure 2:
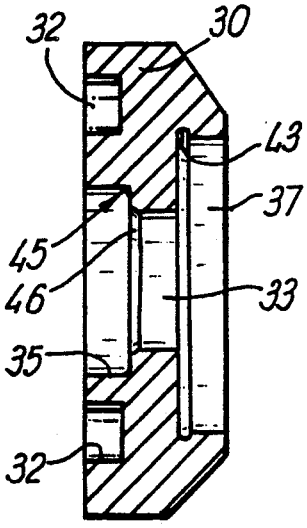
FIG. 2 is a side view of a carrier for a scabbler bit in accordance with the invention.
Figure 3:
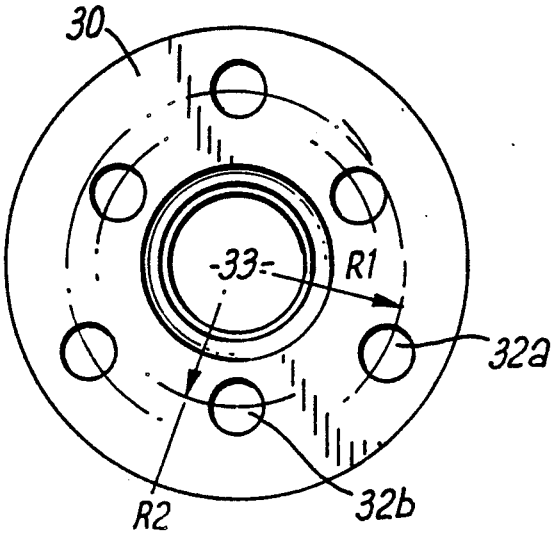
FIG. 3 is an end view of the carrier of FIG. 2.
Figure 5:
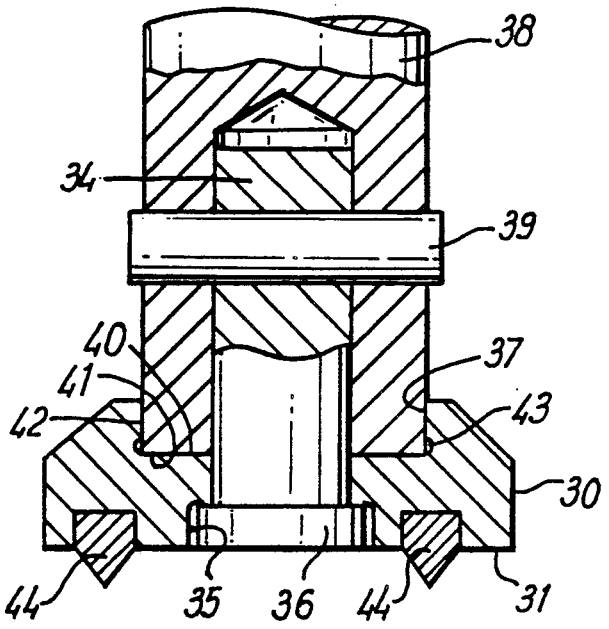

The carrier comprises a body 30 with a lower face 31 formed to provide bores 32 for receipt of scabbler tips 44. As seen in FIG. 3, the bores 32 may be arranged as two sets 32*a* and 32*b* on pitch circles of differing radii R1 and R2, for the reasons discussed in EP-0,068,829. The body 30 has a central bore 33 for passage of a fixing shank 34 (FIG. 5). The bore 33 is enlarged at the lower face 31 to form a recess 35 to receive the head 36 of the shank 34. The opposite face of the body 30 is formed with a counterbore 37 to receive the piston 38, the shank 34 being retained in the piston by a pin 39.

Thus, axial loads on the scabbler bit are transmitted to the piston 38 via shoulder 40 of the carrier bearing on end face 41 of the piston 38, while any sideways of twisting load is resisted by the wall of the counterbore 37 bearing on the side face 42 of the piston 38.

Figure 4:
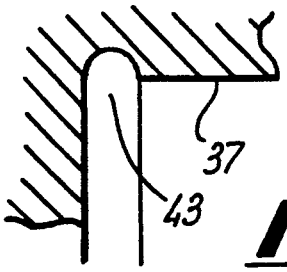
FIG. 4 shows a detail of the carrier to an enlarged scale.

The foot of the counterbore 37 is provided with a semicircular undercut groove 43 (see also FIG. 4), to prevent stress concentration at this point. It is also preferred that the end of the recess 35 is radiused at 45, and the transition between the bore 33 and recess 35 is chamfered at 40° at 46.

Modification and improvements may be made to the foregoing embodiment within the scope of the invention.

I claim:

1. A scabbler bit, for use with a scabbling machine having a piston which has a longitudinal axis and is formed to define an axial bore for receipt of a scabbler bit; the scabbler bit comprising an elongated shank portion to be received in said bore and a carrier extending transversely to said elongated shank portion, said carrier having a lower surface to which are fitted a plurality of scabbler tips; said shank portion being provided with means, spaced from said carrier, for securement in use to the piston; said carrier having a counterbore formed in an upper surface thereof and providing a side wall dimensioned to abut an external circumferential surface of said piston; said shank having a substantially greater extent axially of the piston than said counterbore, whereby the scabbler bit is of substantially male configuration.

2. A scabbler bit as claimed in claim 1, wherein the shank portion comprises a removable shank passing through a central bore of the carrier.

3. A scabbler bit as claimed in claim 2, wherein the shank has a flanged head seating in a recess in said lower surface.

4. A scabbler bit as claimed in claim 3, wherein the recess has a chamfered transition with the throughbore.

5. A scabbler bit as claimed in claim 3, wherein the recess terminates in the carrier in a radius.

6. A scabbler bit as claimed in claim 1, wherein the counterbore terminates in an undercut groove.

7. A scabbler bit as claimed in claim 1, wherein the scabbler tips are arranged on two pitch circles of differing radii.

* * * * *